US007039961B1

(12) United States Patent
Kirk

(10) Patent No.: US 7,039,961 B1
(45) Date of Patent: May 9, 2006

(54) KIRK'S AUTOMATIC TOILET SEAT LIFTER/HOLDER

(76) Inventor: Jerry Kirk, 339 B Grand Ave., Brooklyn, NY (US) 11238

( * ) Notice: Subject to any disclaimer, the term of this patent is extended or adjusted under 35 U.S.C. 154(b) by 0 days.

(21) Appl. No.: 11/141,777

(22) Filed: May 31, 2005

(51) Int. Cl.
*A47K 13/10* (2006.01)

(52) U.S. Cl. ..... 4/246.1; 4/246.3; 4/246.5
(58) Field of Classification Search ..... 4/246.1–246.5
See application file for complete search history.

(56) References Cited

U.S. PATENT DOCUMENTS

| | | | | |
|---|---|---|---|---|
| 3,284,810 | A * | 11/1966 | Stokes | 4/246.1 |
| 4,910,810 | A | 3/1990 | Solomon | |
| 4,951,325 | A | 8/1990 | Tack | |
| 4,995,120 | A * | 2/1991 | Tager | 4/246.1 |
| 5,819,327 | A | 10/1998 | Miller | |
| 6,226,804 | B1 * | 5/2001 | Ballard | 4/246.1 |
| 6,915,532 | B1 * | 7/2005 | Mohammed | 4/246.1 |

* cited by examiner

*Primary Examiner*—Khoa D. Huynh

(57) ABSTRACT

A toilet seat lifting apparatus for use in combination with a toilet and toilet seat. The toilet seat lifting apparatus lifts a toilet seat on a toilet when activated.

4 Claims, 2 Drawing Sheets

KIRK'S AUTOMATIC TOILET SEAT LIFTER/HOLDER

I. BACKGROUND OF THE INVENTION

The present invention concerns that of a toilet seat lifting apparatus for use in combination with a toilet and toilet seat.

II. DESCRIPTION OF THE PRIOR ART

U.S. Pat. No. 5,819,327, issued to Miller, discloses a device for automatically closing a toilet seat after a delay of time using a windup spring assembly mounted on the bottom of the seat.

U.S. Pat. No. 4,951,325, issued to Tack, discloses a toilet seat return device having a device attached to the underside of a seat using a spring leaf secured with a suction cup.

U.S. Pat. No. 4,910,810, issued to Solomon, discloses a toilet seat lifting device using a suction cup that release the seat after a delay.

III. SUMMARY OF THE INVENTION

The present invention concerns that of a toilet seat lifting apparatus for use in combination with a toilet and toilet seat. The toilet seat lifting apparatus lifts a toilet seat on a toilet when activated.

There has thus been outlined, rather broadly, the more important features of a toilet seat lifting apparatus that the detailed description thereof that follows may be better understood and in order that the present contribution to the art may be better appreciated. There are, of course, additional features of the toilet seat lifting apparatus that will be described hereinafter and which will form the subject matter of the claims appended hereto.

In this respect, before explaining at least one embodiment of the toilet seat lifting apparatus in detail, it is to be understood that the toilet seat lifting apparatus is not limited in its application to the details of construction and to the arrangements of the components set forth in the following description or illustrated in the drawings. The toilet seat lifting apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present toilet seat lifting apparatus. It is important, therefore, that the claims be regarded as including such equivalent constructions insofar as they do not depart from the spirit and scope of the present invention.

It is therefore an object of the present invention to provide a toilet seat lifting apparatus which has all of the advantages of the prior art and none of the disadvantages.

It is another object of the present invention to provide a toilet seat lifting apparatus which may be easily and efficiently manufactured and marketed.

It is another object of the present invention to provide a toilet seat lifting apparatus which is of durable and reliable construction.

It is yet another object of the present invention to provide a toilet seat lifting apparatus which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
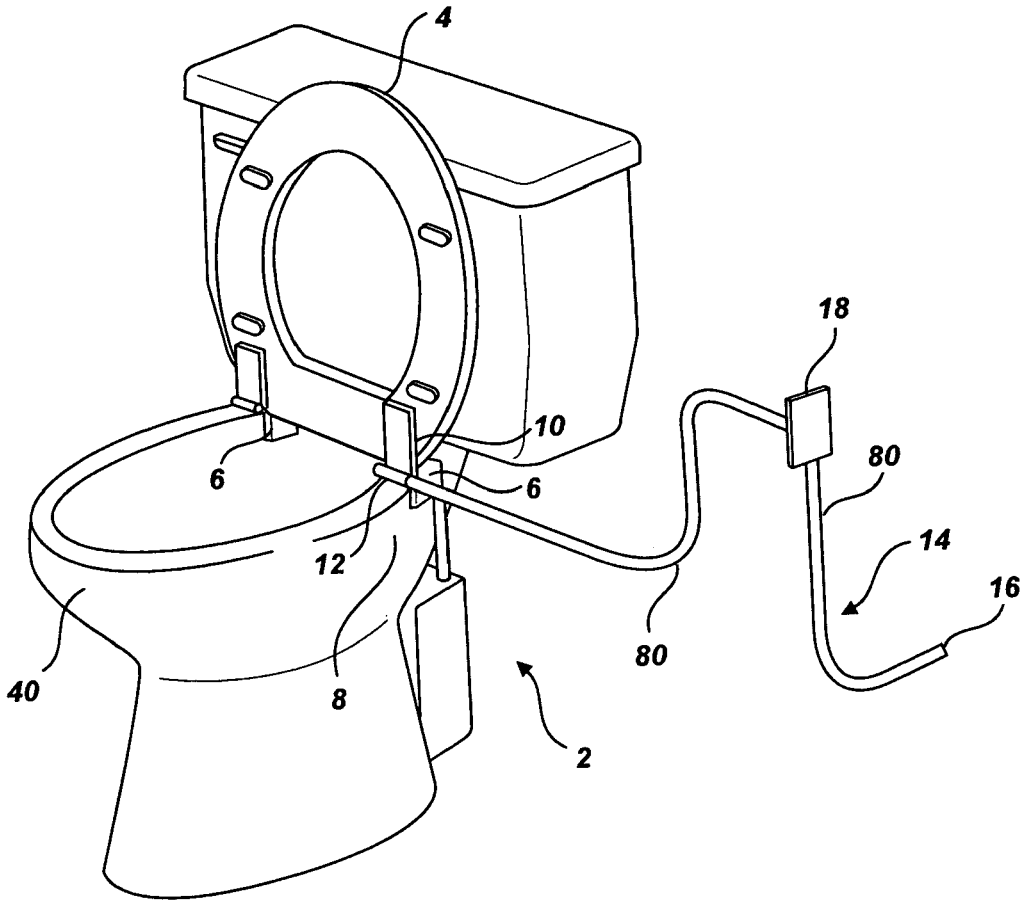
FIG. 1 shows a perspective view of toilet seat lifting apparatus as it appears in combination with a toilet seat in the "up" position.
Figure 2:
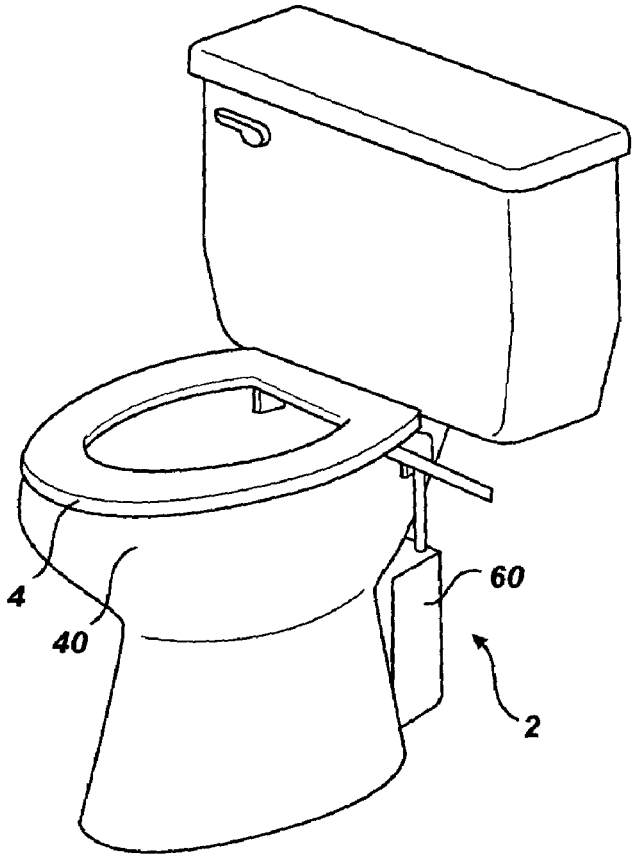
FIG. 2 shows a perspective view of toilet seat lifting apparatus as it appears in combination with a toilet seat in the "down" position.
Figure 3:
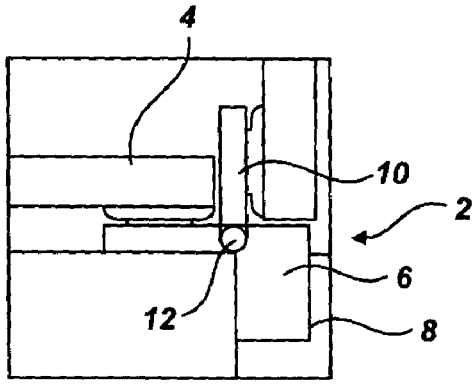
FIG. 3 shows a side view of toilet seat lifting apparatus as it appears in combination with a toilet seat in the "up" position.

FIG. 1 shows a perspective view of toilet seat lifting apparatus 2 as it appears in combination with a toilet seat 4 in the "up" position, while FIG. 2 shows a perspective view of toilet seat lifting apparatus 2 as it appears in combination with a toilet seat 4 in the "down" position. Furthermore, FIG. 3 shows a side view of toilet seat lifting apparatus 2 as it appears in combination with a toilet seat 4 in the "up" position.

Toilet seat lifting apparatus 2 comprises two separate lifting units 6, with each lifting unit 6 comprising a clip 8, a lifting piece 10, and a hydraulic lifter 12. The lifting piece 10 is connected to the clip 8 by the hydraulic lifter 12. The lifting piece 10 is fixedly attached to the hydraulic lifter 12, while the hydraulic lifter 12 is pivotally attached to the clip 8.

Toilet seat lifting apparatus 2 comprises power means 14, which is preferably standard household current 16. In between the power means 14 and the toilet seat lifting apparatus 2 is located a wall button 18 that, once pressed, will allow power to flow for a brief amount of time from the power means 14 to the toilet seat lifting apparatus 2. Power means 14 is connected to the hydraulic lifters 12 by electrical lines 80.

As can be seen from the figures, each of the clips 8 is attached to the toilet bowl 40 near the rear end of the toilet bowl 40. The toilet seat 4 is attached to each of the hydraulic lifters 12, which are also connected to the power means 14 via a cord. Once the power means 14 is activated and power is applied to each of the hydraulic lifters 12, then the hydraulic lifters 12 will rotate the seat from the position seen in FIG. 2 to the position seen in FIG. 1.

The wall button 18 acts as a circuit in between the power means 14 and the hydraulic lifters 12. The hydraulic lifters 12, when receiving power from the power means 14, will cause the toilet seat 4 to physically lift up. After a brief amount of time or by pressing the wall button 18 or sensor a second time, the wall button 18 will break the power connection in between the power means 14 and the hydraulic lifters 12, causing the toilet seat 4 to slowly lower.

The wall button 18 can be a manual set-up or in the alternative, can be a sensor that merely senses the presence of an object placed in front of it. With either embodiment, the wall button 18 generally will act as a circuit in between the power means 14 and the hydraulic lifters 12.

In addition, a secondary power source 60 is attached to the electrical lines 80. The secondary power source 60 generally will serve as a backup for the toilet seat lifting apparatus 2 should the regular power means 14 be unavailable.

I claim:

1. A toilet seat lifting apparatus in combination with a toilet, the toilet including a toilet bowl, the toilet also including a toilet seat, the toilet seat lifting apparatus comprising:

a pair of lifting units, each lifting unit comprising a clip, the clip being attached to the toilet bowl, each lifting unit further comprising a hydraulic lifter, the hydraulic lifter being pivotally attached to the clip and hingedly securing the toilet seat to the toilet bowl, each lifting unit further comprising a lifting piece, each lifting piece being fixedly connected to the lifter, wherein the lifting piece is connected to an underside surface of the toilet seat, power means for providing power to the toilet seat lifting apparatus, an electrical line to connect the power means to each of the lifting units, a switch located between the power means and each of the lifting units, wherein the switch normally rests in the "off" position, and further wherein activating the switch causes the lifting units to lift the toilet seat for a short period of time, further wherein the toilet is free from any additional hinges between the toilet seat and the toilet bowl, further wherein the lifting apparatus does not extend beyond the sides of the toilet seat.

2. A toilet seat lifting apparatus in combination with a toilet according to claim 1 wherein the power means to provide power to the toilet seat lifting apparatus further comprises standard household current.

3. A toilet seat lifting apparatus in combination with a toilet according to claim 1 wherein the circuit located in between the power means and each of the lifting units further comprises a wall switch.

4. A toilet seat lifting apparatus in combination with a toilet according to claim 3 wherein the toilet seat lifting apparatus further comprises a secondary power source.

* * * * *